US005798773A

United States Patent [19]

Hiramatsu et al.

[11] Patent Number: 5,798,773

[45] Date of Patent: Aug. 25, 1998

[54] RECORDING APPARATUS AND METHOD FOR CORRECTION OF DISCHARGE FAILURE AND DENSITY UNEVENNESS

[75] Inventors: Akira Hiramatsu, Yokohama; Kiyoharu Tanaka, Tokyo; Yasuyuki Takanaka, Yokohama, all of Japan

[73] Assignee: Canon Kabushiki Kaisha, Tokyo, Japan

[21] Appl. No.: 877,310

[22] Filed: Jun. 17, 1997

Related U.S. Application Data

[63] Continuation of Ser. No. 180,477, Jan. 12, 1994, abandoned, which is a continuation of Ser. No. 832,996, Feb. 10, 1992, abandoned.

[30] Foreign Application Priority Data

Feb. 20, 1991 [JP] Japan ..... 3-026172

[51] Int. Cl.[6] ..... B41J 2/05; B41J 2/165

[52] U.S. Cl. ..... 347/19; 347/23

[58] Field of Search ..... 347/19, 23, 16, 347/106, 14

[56] References Cited

U.S. PATENT DOCUMENTS

| | | | |
|---|---|---|---|
| 4,313,124 | 1/1982 | Hara . | |
| 4,328,504 | 5/1982 | Weber | 347/19 |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,617,580 | 10/1986 | Miyakawa | 347/104 |
| 4,723,129 | 2/1988 | Endo et al. . | |
| 4,740,796 | 4/1988 | Endo et al. . | |
| 4,907,013 | 3/1990 | Hubbard et al. | 347/19 |
| 4,977,459 | 12/1990 | Ebinuma | 347/19 X |
| 5,018,884 | 5/1991 | Hirano | 347/43 |
| 5,276,459 | 1/1994 | Danzuka et al. | 347/14 |

FOREIGN PATENT DOCUMENTS

| | | | |
|---|---|---|---|
| 0348234 | 12/1989 | European Pat. Off. | B41J 3/04 |
| 155960 | 9/1983 | Japan | B41J 3/04 |
| 59-123670 | 7/1984 | Japan | B41J 3/04 |
| 59-138461 | 8/1984 | Japan | B41J 3/04 |
| 1130948 | 5/1989 | Japan | B41J 3/04 |
| 01476 | 4/1985 | WIPO | B41J 3/44 |

*Primary Examiner*—Joseph W. Hartary

*Attorney, Agent, or Firm*—Fitzpatrick, Cella, Harper & Scinto

[57] ABSTRACT

A recording apparatus records an image by scanning a first recording head relative to a recording medium of a particular type. The apparatus includes the first recording head, a pattern recording controller, a reader, a restoring device, a second recording head, a discriminator and a control unit. The pattern recording controller controls recording of a predetermined pattern with the first recording head at a predetermined timing either on the recording medium or on a pattern recording medium different from the recording medium. The reader reads the predetermined pattern and the restoring device performs a discharge restoring operation of the recording head. The discriminator discriminates a recording state of the first recording head, based on the predetermined pattern read by the reader. The control unit enables the second recording head to record the image to be recorded by the first recording head, in a case that after the discriminator discriminates the recording state as being poor and thereafter the discharge restoring operation performed by the restoring device and a pattern recording operation by the pattern recording controller have been executed a predetermined number of times, the discriminator has discriminated the recording state as being still poor.

27 Claims, 9 Drawing Sheets

RECORDING APPARATUS AND METHOD FOR CORRECTION OF DISCHARGE FAILURE AND DENSITY UNEVENNESS

This application is a continuation of application Ser. No. 08/180,477 filed Jan. 12, 1994, now abandoned, which is a continuation of application Ser. No. 07/832,996 filed Feb. 10, 1992, abandoned.

BACKGROUND OF THE INVENTION

1. Field of the Invention

The present invention relates to a recording apparatus for forming an image according to an image signal or an original image, and more particularly to an ink jet recording apparatus.

2. Related Background Art

Among various recording apparatuses already known, the ink jet recording apparatus is attracting particular attention for full color image formation, because such apparatus, which forms dot records by discharging ink droplets from nozzles of a recording head, is advantageous in it's configuration and in the running cost. In this recording method, the recording is generally achieved by scanning motions of the recording head, having a nozzle array of a certain width (for example about 16 mm) in longitudinal and transversal directions relative to a recording material.

However, because of eventual fluctuations in the amount and direction of ink discharge among the nozzles of the ink jet recording head, there are formed streaks on the recorded image. For this reason, the recorded image shows cyclic streaking unevenness with a pitch corresponding to the width of the recording head, thus deteriorating the image quality. Also variation of such unevenness in time is another drawback.

Also eventual deposition of dusts or solidified ink on the nozzles of the recording head hinders proper ink discharge from the nozzles (hereinafter called discharge failure), thus causing a line-shaped defect on the recorded image and deteriorating the image quality.

In order to prevent such unevenness of the recording head, so-called head shading, there is already commercialized a recording apparatus in which a predetermined pattern is printed and said unevenness is corrected by reading the printed pattern visually or by a reader.

However, in such apparatus, since said correction is manually conducted by the operator, the correcting operation depends on the discretion of the operation and may not be executed properly. Also no sufficient measures are provided for the discharge failures.

It is desired to constantly detect such phenomena deteriorating the image quality and to effect suitable correction. Particularly in case of employing a long web-shaped recording material, the recording operation may be conducted continuously on a very long recording material of 100 meters or longer, so that the unevenness resulting from discharge failure during such recording operation poses a serious problem. In case said web-shaped recording material is composed of woven fabric, the probability of such discharge failure is significantly higher than in the ordinary recording paper, particularly coated paper, because fine fiber dusts tend to deposit on or in the vicinity of the nozzles of the recording head.

SUMMARY OF THE INVENTION

In consideration of the foregoing, an object of the present invention is to provide a recording apparatus capable of constantly providing stable recorded images with a simple structure.

Another object of the present invention is to provide a recording apparatus capable of stable recording on a web-shaped recording medium.

Still another object of the present invention is to provide a recording apparatus capable of stable recording on a recording medium with a rough surface such as woven fabric.

The above-mentioned objects can be attained, according to the present invention, by a recording apparatus capable of forming an image by scanning motions of a recording head relative to a recording medium, comprising pattern recording means for recording a predetermined pattern by said recording head at a predetermined interval, reader means for reading said predetermined pattern recorded by said pattern recording means, discrimination means for discriminating the recording state of said recording head, based on the predetermined pattern read by said reader means, and control means for controlling said recording head according to the result of discrimination by said discrimination means.

The recording apparatus of the present invention, having the above-explained configuration, is capable of preventing the deterioration of image quality by suitably checking the unevenness or discharge failure of the recording head and effecting unevenness correction or discharge recovery operation, or requesting the operator to replace the recording head.

DETAILED DESCRIPTION OF THE PREFERRED EMBODIMENT

Now the present invention will be clarified in detail by preferred embodiments thereof shown in the attached drawings.

Figure 1:
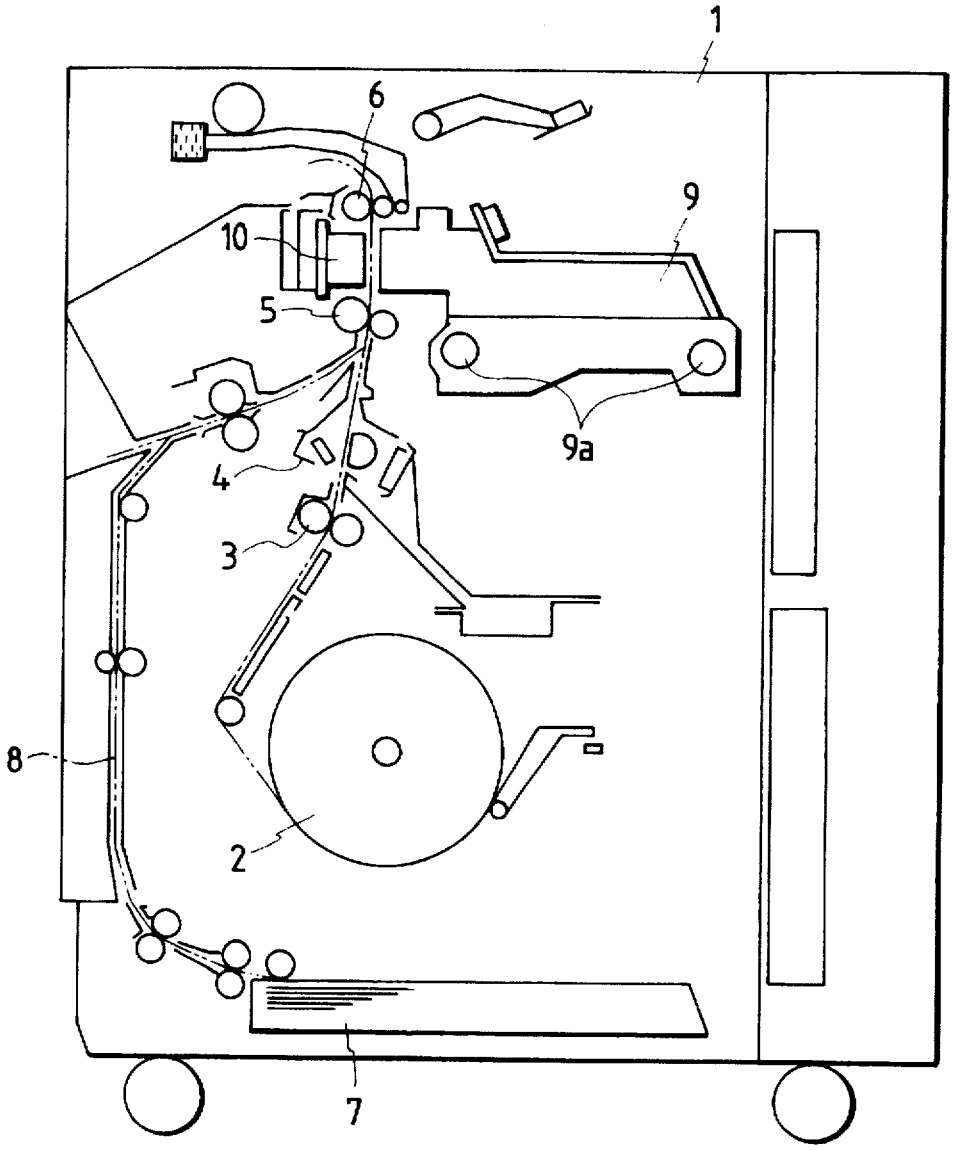
FIG. 1 is a cross-sectional view of an embodiment of the recording apparatus of the present invention.

FIG. 1 is a cross-sectional view of a recording apparatus of the present invention, wherein shown are a main body 1; a roll 2 of web-shaped recording material (medium); a cutter 4 for cutting the recording material into a predetermined length; paired transport rollers 3, 5 for transporting the recording material in a predetermined direction; and a sub scanning roller 6 for positioning the recording material by precisely transporting the same by an amount corresponding to the recording width of a recording head to be explained later. The above-mentioned components constitute a transport path for the recording material supplied from the roll 2.

There are further provided a cassette 7 for storing sheet-shaped recording materials; guide members 8 for guiding the recording material from the cassette 7 into the transport path from said roll 2, immediately in front of the transport rollers 5; a carriage 9 bearing a recording head (not shown) and movably supported by a pair of main scanning rails 9*a* in a direction perpendicular to the plane of the drawing; and a platen member 10 positioned opposite to said carriage 9 across the recording material and provided with suction means that operates for example, by air suction or electrostatic suction, in order to maintain the recording material in flat state and to prevent the recording material from contacting the recording head during the recording operation.

In the following there will be explained related mechanisms, with reference to FIG. 2.

The carriage 9 is provided with recording heads 9C, 9M, 9Y, 9Bk respectively corresponding to cyan, magenta, yellow and black colors. An ink supply system 11 for supplying said recording heads with inks is provided with ink cartridges 11C, 11M, 11Y, 11Bk respectively corresponding to said colors. Inks are supplied to said recording heads, by means of unrepresented pumps, through tubes 12C, 12M, 12Y, 12Bk. A motor 13 drives the carriage 9 in the main scanning direction (lateral direction in the drawing), by means of a pulley 14 fixed to said motor 13, another pulley 15 and a belt 16. A motor 17 drives the ink supply system 11 in the main scanning direction, in synchronization with the carriage 9, by means of a pulley 18 fixed to said motor 17, another pulley 19 and a belt 20.

A recording material 22, composed for example of paper in the rolled or cut state as explained above, is transported upwards by the transport rollers 5 and the sub scanning roller 6. A cap member 23 is provided at a position for effecting an operation for eliminating the causes of image quality deterioration (hereinafter called discharge recovery operation). Said cap member 23 serves to cover the nozzle faces of the recording heads 9C, 9M, 9Y, 9Bk, and the ink is discharged or pushed out from the nozzles in such capped state, by activation or pressurization of the recording heads. At the same time high-speed air flow is directed toward the nozzle faces of the recording heads in the cap member 23, thus blowing off thus expelled ink and dusts from the nozzle faces, and eliminating the discharge failure and unevenness.

A monitor 31, for monitoring the recording state of the recording heads, reads a predetermined pattern (of uniform density), printed at a predetermined interval on the right-end margin of the recording material 22.

Figure 3:
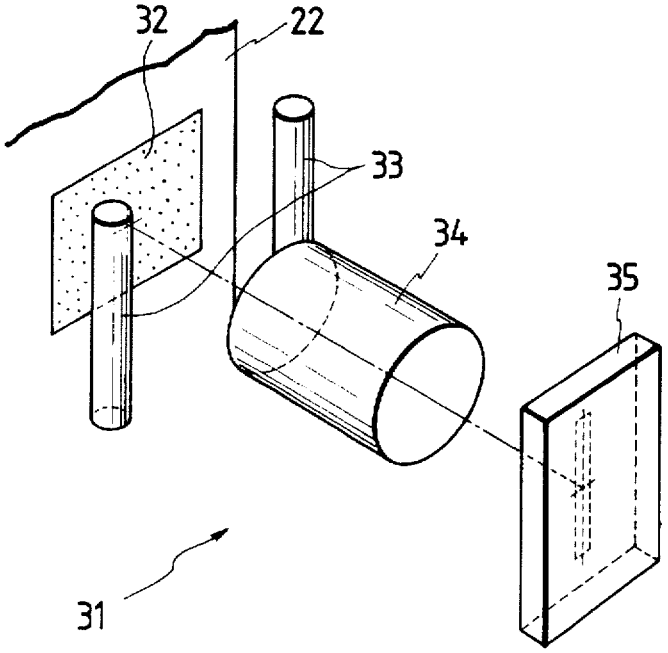
FIG. 3 is a perspective view of a monitor shown in FIG. 2.

FIG. 3 shows the details of said monitor 31. A calibration pattern 32, containing each of cyan, magenta, yellow and black colors in uniform density and by a scanning line, is printed at a predetermined interval at an end margin of the recording material 22. There are also provided a pair of lamps 33 for illuminating said calibration pattern 32; a projection lens 34 for projecting the image of said pattern 32 illuminated by the lamps 33; and a sensor 35, such as a CCD, for photoelectrically converting the image of the calibration pattern 32 projected by said lens 34. The number of elements in said sensor is preferably at least equal to that of the recording elements in the recording head. The output of said sensor 35 is used for detecting the presence of discharge failure in the recording head and whether the unevenness of printing exceeds a predetermined level, and the aforementioned discharge recovery operation is conducted if necessary.

Now the normal recording sequence will be explained with reference to FIGS. 1 and 2. Referring to FIG. 1, when a recording material sensor (not shown) positioned in front of the transport rollers 5 detects a recording material fed from the roll 2 or the cassette 7, the transport rollers 5 and the sub scanning roller 6 advances the recording material by a predetermined amount, until the leading end thereof reaches the sub scanning roller 6.

Figure 2:
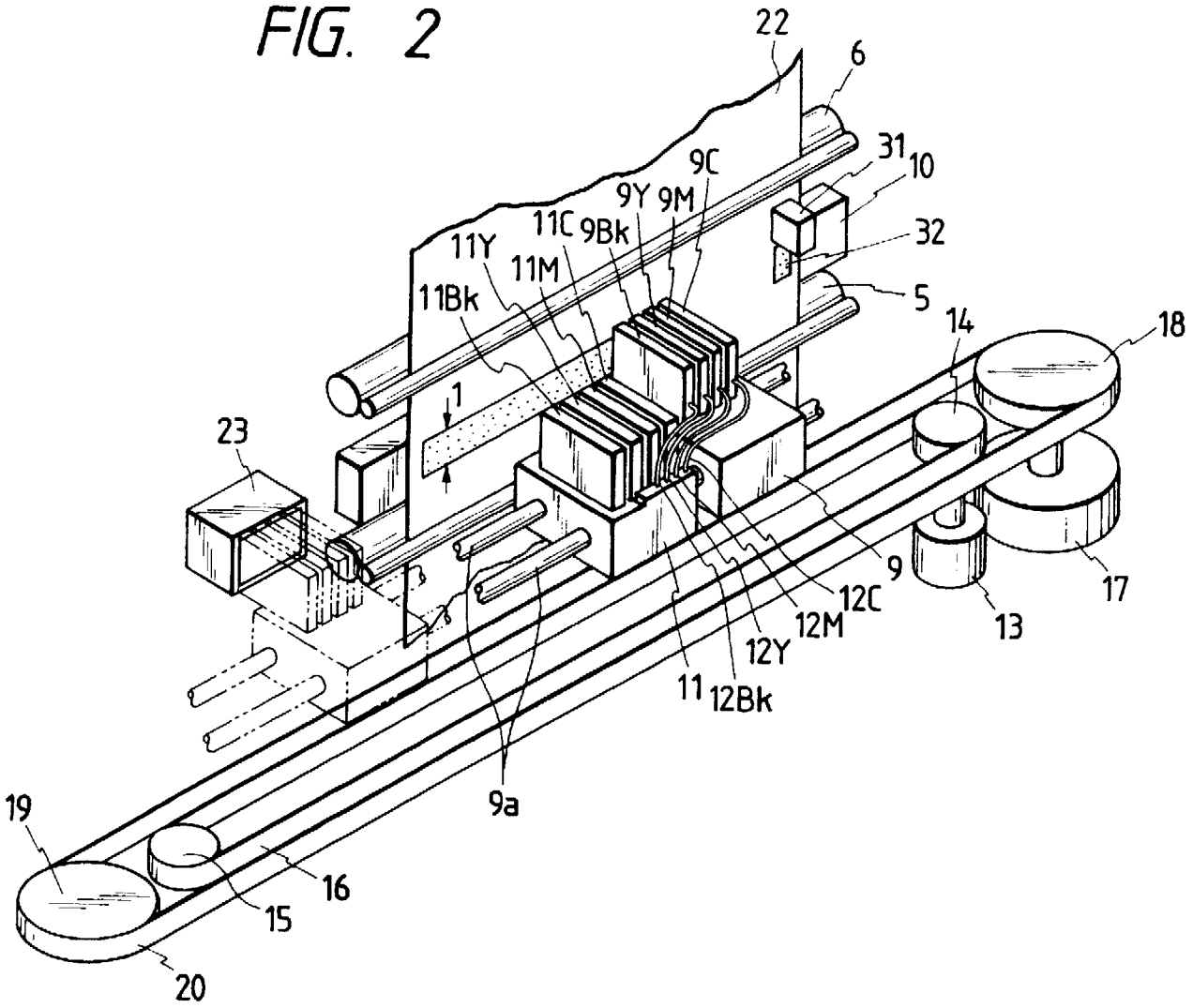
FIG. 2 is a perspective view of a recording head and related mechanisms shown in FIG. 1.

When the leading end of the recording material 22 reaches the sub scanning roller 6 in FIG. 2, the carriage 9 and the ink supply system 11 are respectively driven by the motors 13, 17 in the scanning direction (to the right in FIG. 2). At the same time, the recording heads 9C, 9M, 9Y, 9Bk effect recording with a width I, according to image signals.

After recording of a line, the carriage 9 and the ink supply system 11 are returned to a predetermined position at the left side in FIG. 2, and the recording material 22 is simultaneously advanced by the motor 21, by an amount precisely corresponding to said printing width I.

After the above-explained sequence of recording and recording material transportation by a predetermined number of cycles, the recording material 22 is discharged from the apparatus.

Figure 4:
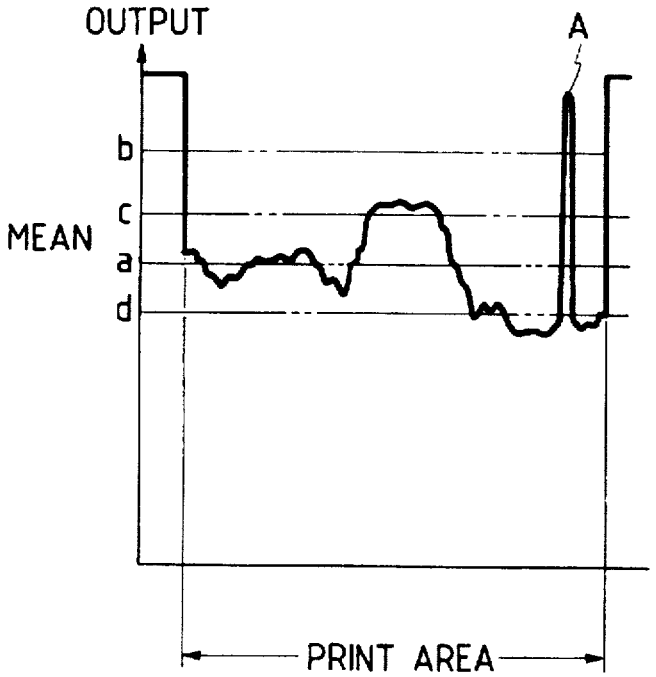
FIG. 4 is a chart showing the sensor output of said monitor.

In the following an explanation will be given on the monitor 31. FIG. 4 shows the output signal of the sensor 35 of said monitor 31, wherein the abscissa corresponds to the pixels of said sensor 35, while the ordinate indicates the output of each pixel. The output of the sensor 35 is subjected to so-called shading correction, utilizing the recording material before printing as the white level. Since each pixel output corresponds to each nozzle of the recording head, the amount of ink discharge from each nozzle can be determined.

A discharge failure is identified if the output signal becomes larger, even in one position, than a slice level b which is larger by a predetermined amount than the average pixel output a. Also large unevenness is identified if the output signal becomes larger than a slice level c which is larger by a predetermined amount than said average a or becomes smaller than a slice level d which is smaller by a predetermined amount than said average a. Empirically, the slice level b for detecting the discharge failure is preferably larger, by about 50%, than the average a, while the slice levels c, d for unevenness detection are preferably different, by 5 to 10%, from the average a.

However, the detection of level of unevenness is not limited to such method. There may instead be employed, for example, a method of calculating the standard deviation of the pixel outputs of the sensor and evaluating the level of unevenness from the magnitude of said standard deviation, or a method of calculating the sum A of absolute difference of adjacent pixels ($A=\Sigma|a_i-a_{i+1}|$) and evaluating said level by the magnitude of said sum A.

For the purpose of unevenness correction, the pixel output values of the sensor 35, corresponding to the nozzles of the recording head, may be employed. However, in order to reduce the influence of noises etc., it is also possible to employ the average value of mutually adjacent pixels, for example three adjacent pixels of the sensor.

Figure 5:
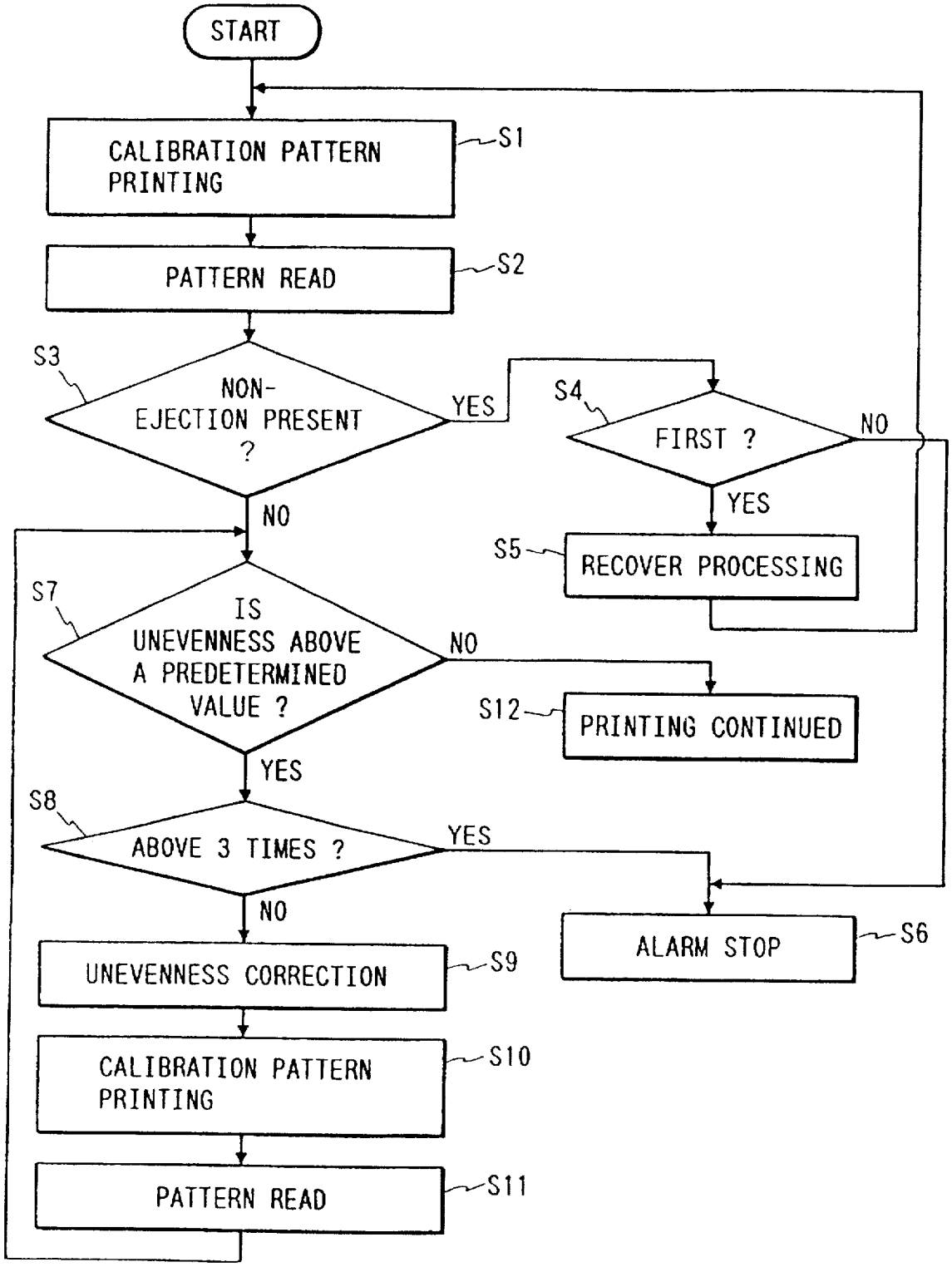
FIG. 5 is a flow chart of the control sequence of said embodiment.

Now reference is made to FIG. 5 for explaining a calibration sequence for detecting the discharge failure and unevenness and effecting the discharge recovery operation. As explained in the foregoing, in a series of recording sequences, the calibration patterns are printed at a predetermined interval (step S1). Said calibration pattern is read by the monitor 31 (step S2), and the presence of discharge failure is discriminated by the algorithm explained above (step S3).

If a discharge failure is identified, there is discriminated whether or not to effect the recovery operation (step S4). The discrimination in the step S4 depends on whether the recovery operation is already conducted in this sequence. This is based on an empirical fact that most discharge failures are resolved if the aforementioned discharge recovery operation is properly conducted. After said discharge recovery operation (step S5), the sequence returns to the step S1 for calibration pattern printing, step S2 for pattern reading and step S3 for discrimination of the discharge failure. If the step S4 again identifies the discharge failure, the recovery operation is not conducted, but an alarm for a head trouble is given and the operation of the apparatus is interrupted (step S6).

On the other hand, if the step S3 identifies the absence of discharge failure, there is discriminated the absence of unevenness, according to the unevenness discriminating algorithm explained before (step S7). If the unevenness is identified absent, the recording operation is continued (step S12). On the other hand, if the step S7 identifies that the unevenness is equal to or larger than a predetermined level, there is discriminated whether to effect the unevenness correction operation (step S8), and there is conducted the unevenness correction (step S9). The unevenness correction in the step S9 is conducted, based on the output signal of the pattern read in the step S2, by correcting the drive signal (signal duration or voltage) of the required nozzles of the recording head. Then a pattern of uniform density, same as printed in the step S1, is printed (step S10), and the printed pattern is read by the monitor 31 (step S11).

The above-mentioned steps S7, S8, S9, S10 and S11 are repeated by a predetermined number of cycles (three times in the present embodiment), and, if the level of unevenness is still high, an alarm for a head trouble is given and the operation of the apparatus is interrupted (step S6). This is based on an empirical fact that this unevenness correcting sequence generally provides a practically sufficient effect after three cycles though the effect becomes still enhanced with a further increased number of cycles, while a significant unevenness after three correcting cycles is mostly caused by a trouble based in the recording head, such as the expired service life thereof.

The discharge state of the recording heads can be maintained in satisfactory manner, by conducting the above-explained calibration sequence for each of the cyan, magenta, yellow and black colors. Consequently the working rate of the apparatus can be improved even in the unmanned state, and such measure is particularly effective in case of using continuous web-shaped recording medium.

In the present embodiment, the recording material is assumed to be ordinary paper, but similar effects can also be obtained for other recording materials such as woven fabric.

Figure 6:
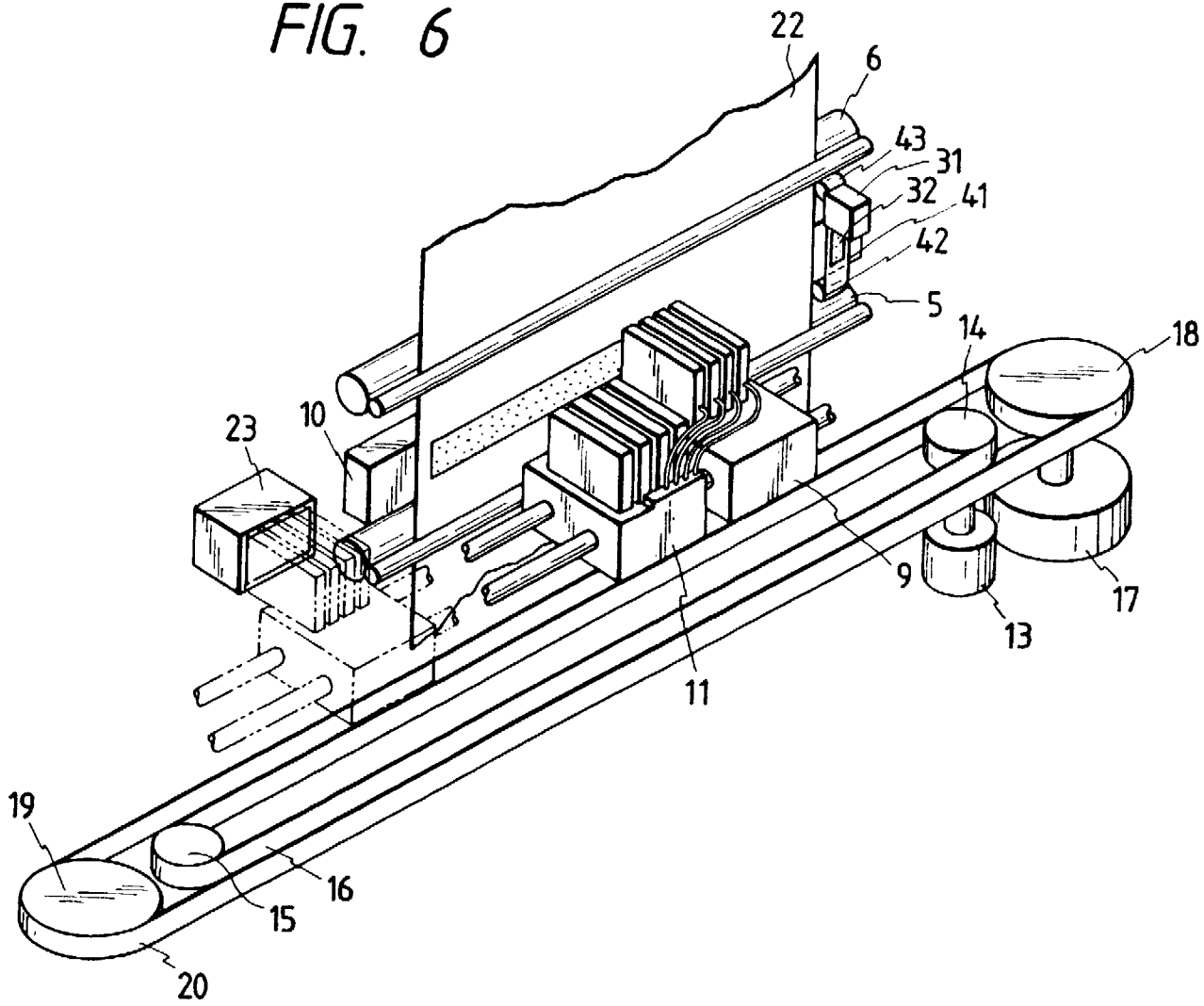
FIG. 6 is a perspective view of a recording head and related mechanisms in a second embodiment of the present invention.

In the following there will be explained a second embodiment of the present invention shown in FIG. 6, wherein components equivalent to those in the first embodiment shown in FIG. 2 are represented by same numbers.

This embodiment is featured by the presence of a recording material exclusive for calibration pattern printing. At an end of the platen 10, there is provided a recording material 41 exclusive for monitoring, supplied from a roll 42 and taken up, after printing, on a roll 43. The sequences of printing and calibration in the present embodiment will not be explained further, as they are same as in the first embodiment.

This embodiment, enabling recording on the entire area of the recording material without any margin therein, avoids waste of the recording material and is particularly effective for long continuous recording.

Figure 7:
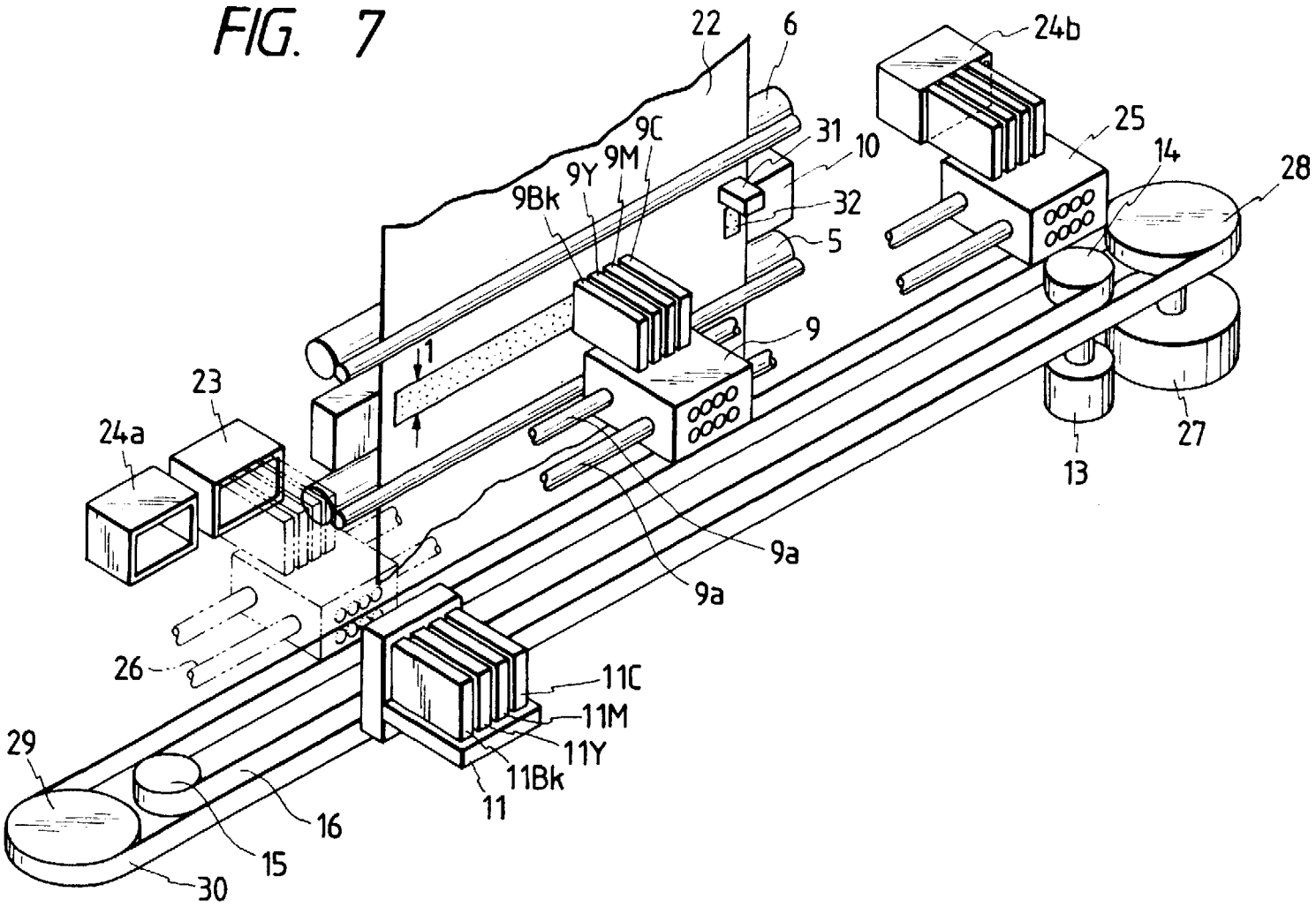
FIG. 7 is a perspective view of a recording head and related mechanisms in a third embodiment of the present invention.

In the following there will be explained a third embodiment of the present invention. The cross-sectional structure of the apparatus of this embodiment will not be explained as it is basically the same as that of the first embodiment shown in FIG. 1. FIG. 7 is a perspective view of a recording head and related mechanisms of the present embodiment, wherein components equivalent to those in FIG. 2 are represented by same numbers.

The carriage 9 is provided with the recording heads 9C, 9M, 9Y, 9Bk respectively corresponding to cyan, magenta, yellow and black colors. The ink supply system 11, for ink supply to said recording heads, is provided with ink cartridges 11C, 11M, 11Y, 11Bk respectively corresponding to said colors. The ink supply is conducted, when the carriage is in a chain-lined position 26 (hereinafter called ink supply position), from said system 11 to sub tanks (not shown) of the carriage 9 by unrepresented pumps, as will be explained later in more detail.

A reserve carriage 25, same in structure as the carriage 9, also receives the ink supply from the ink supply system 11 at the ink supply position 26. A motor 13 drives the carriage 9 in the main scanning direction (lateral direction in the drawing) by means of a drive pulley 14 fixed to said motor, a pulley 15 and a belt 16. A motor 27 drives the reserve carriage 25 in said main scanning direction by a drive pulley 28 fixed to said motor 27, another pulley 29 and a belt 30.

Caps 24*a*, 24*b* are provided for respectively covering the nozzles of the recording heads of the carriage 9 and the reserve carriage 25 at the home positions thereof, thereby preventing viscosity increase of the inks.

Figure 8:
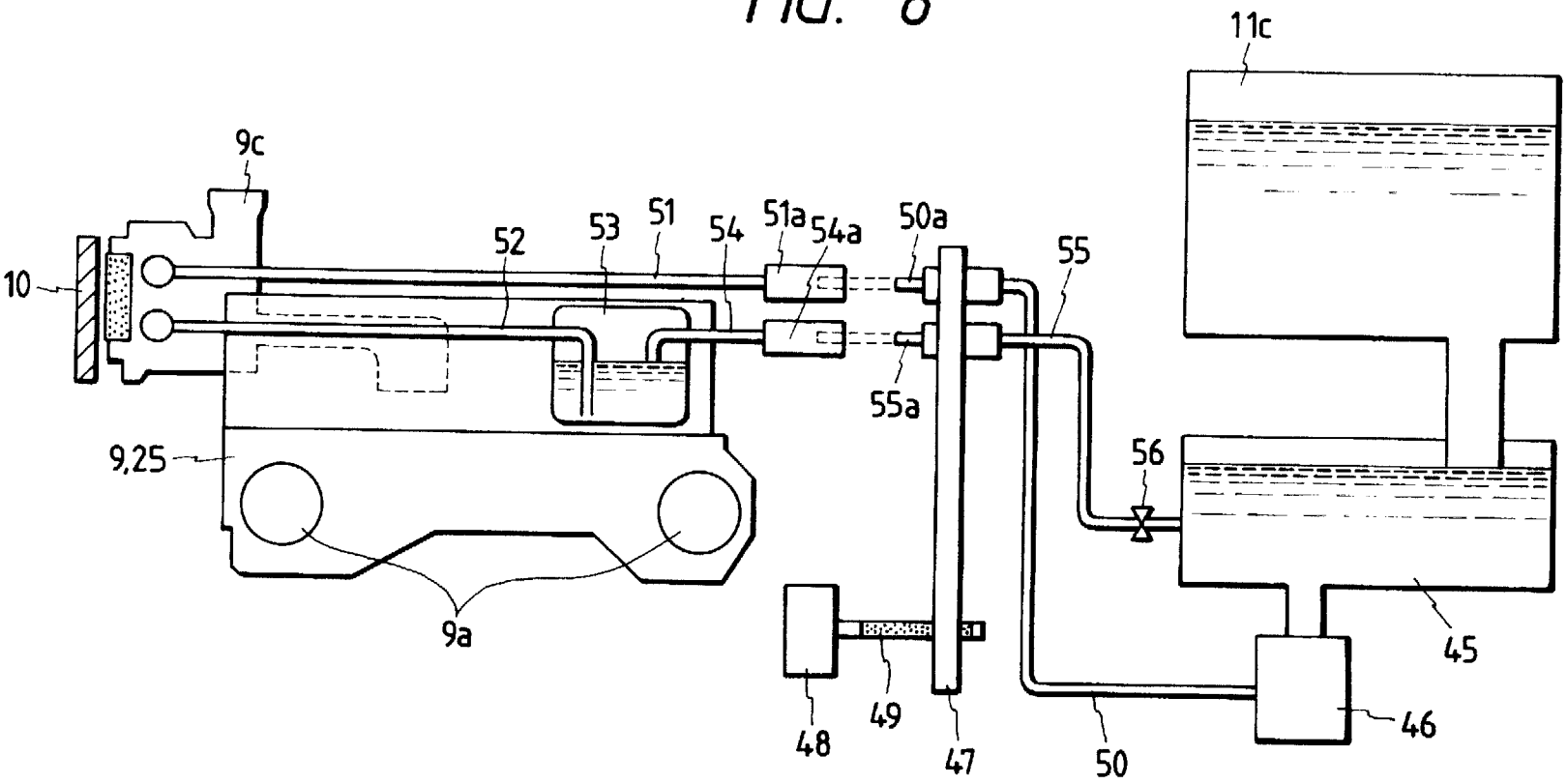
FIG. 8 is a cross-sectional view showing an ink supply system.

Now reference is made to FIG. 8 for explaining the ink supply process.

There are shown a main tank 45 receiving ink supply from the ink cartridge 11C; a pump 46 for effecting ink pressurization for discharge recovery for the recording head 9C and ink supply to a sub tank 53 provided on the carriage; a support member 47 supporting a connector of an ink supply tube and moveable laterally by a motor 48 and a feed screw 49; a tube 50 connecting the pump 46 with the support member 47 and having a connector member 50*a* at an end; a tube 51 provided at an end with a connector member 51*a* engageable with said connector member 50*a* and supplying ink to the recording head 9C, said connector member 51*a* being provided with a valve (not shown) which is normally closed and opened only when coupled with the connector member 50*a*; a tube 52 connecting the recording head 9C with a sub tank 53 provided on the carriage; a tube 54 for returning the ink, overflowing at the ink supply, from the sub tank, having a connector member 54*a* at an end; a tube 55 connecting the support member 47 with the main tank 45 and provided at an end with a connector member 55*a* engageable with said connector member 54*a*; and a valve 56 provided in the tube 55, to be closed at the discharge recovery operation for ink pressurization.

The ink is supplied, with said connector members mutually coupled at said ink supply position, by the pump 46 to the tubes 50, 51, recording head 9C, tube 52, and sub tank 53, and, when the sub tank 53 is filled, the overflowing ink is returned to the main tank 55 through the tubes 54, 55. In this operation the valve 56 is in the open state. On the other hand, the ink pressurization at the discharge recovery operation is conducted, also at said ink supply position, with the connector members being mutually coupled, by activating the pump 46 with the valve 56 closed, whereby the ink pressure in the supply path is elevated to expel the ink from the nozzles of the recording head. The ink supply to the recording head in the course of actual recording operation is conducted from the sub tank 53 through the tube 52.

The foregoing explanation has been limited to the system for cyan color, but a similar system is provided for each of magenta, yellow and black colors. Also the reserve carriage 25 has a same structure, and the ink supply and discharge recovery are conducted in the ink supply position shown in FIG. 7.

In the following there will be explained the recording sequence of the above-explained third embodiment.

Referring to FIG. 7, when the leading end of the recording material 22 is transported to the sub scanning roller, the carriage 9 is driven in the scanning direction (to the right in FIG. 7) by the motor 13. At the same time the recording heads 9C, 9M, 9Y, 9Bk effect recording with a width I, according to image signal.

After recording of a line, the carriage 9 is returned to a predetermined position at the left side, and the recording material 22 is advanced by a distance precisely corresponding to the printing width I. The above-explained sequence of recording and transportation of recording material is repeated for a predetermined number of cycles, and then the recording material 22 is discharged from the apparatus.

Figure 9:
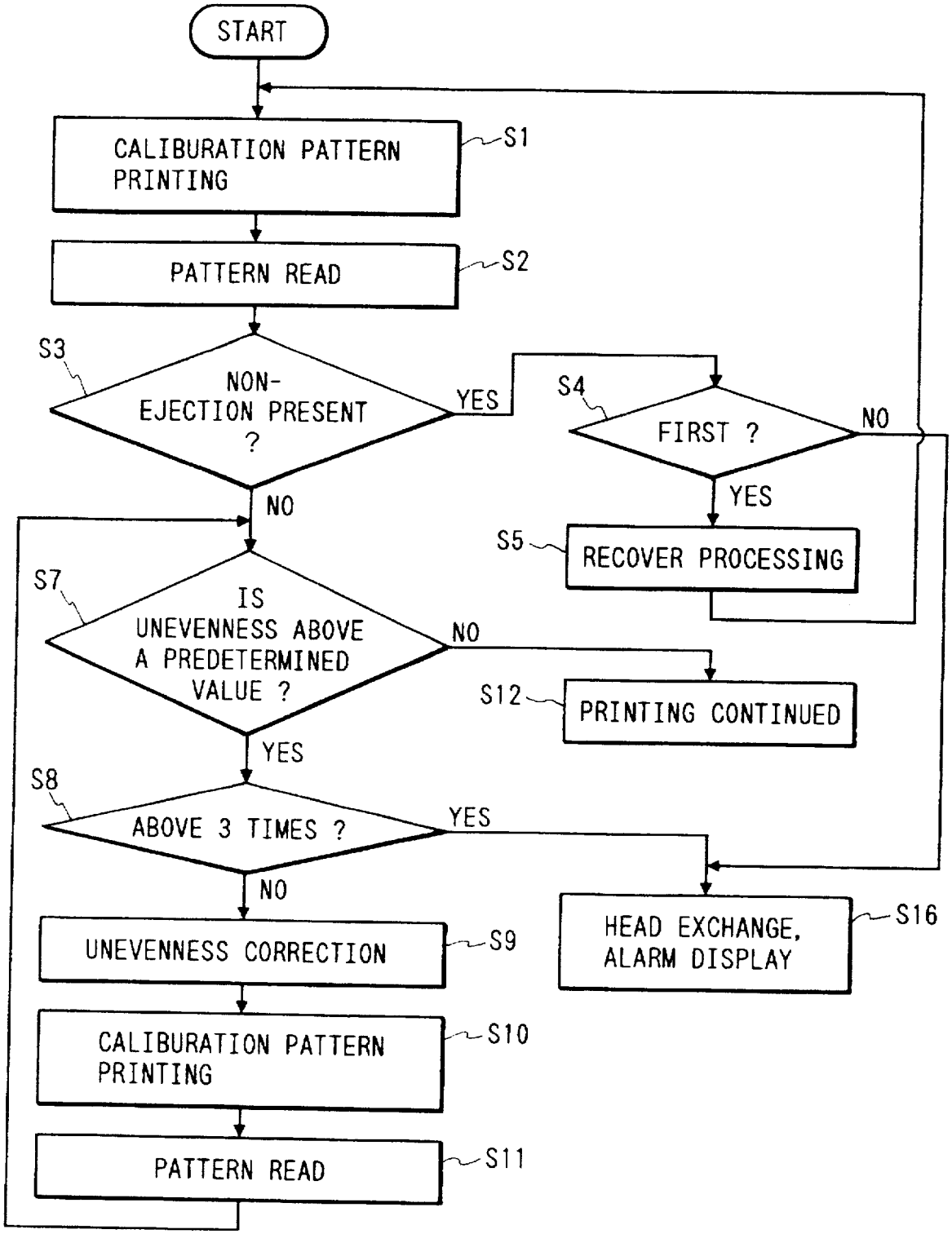
FIG. 9 is a flow chart of the control sequence of the third embodiment.

Now reference is made to FIG. 9 for explaining the calibration sequence for detecting the discharge failure or unevenness and effecting the discharge recovery operation in this third embodiment. This sequence is different from that of the first embodiment in FIG. 5, in the process when a trouble in the recording head is identified. When a trouble in the recording head is identified, the step S6 in FIG. 5 provides an alarm display and terminates the function of the apparatus. In the present embodiment having a reserve recording head as explained above, a step S16 provides the alarm for the trouble in the recording head and replaces the recording head by activating the reserve carriage 25.

Thus the present embodiment monitors the unevenness and discharge failure in the recording heads, effects correction for unevenness and discharge recovery operation when required, and automatically replaces the recording heads when recovery is identified as not being possible, thereby preventing the deterioration in image quality and avoiding the interruption of recording. Thus the working rate of the apparatus can further be improved.

Figure 10:
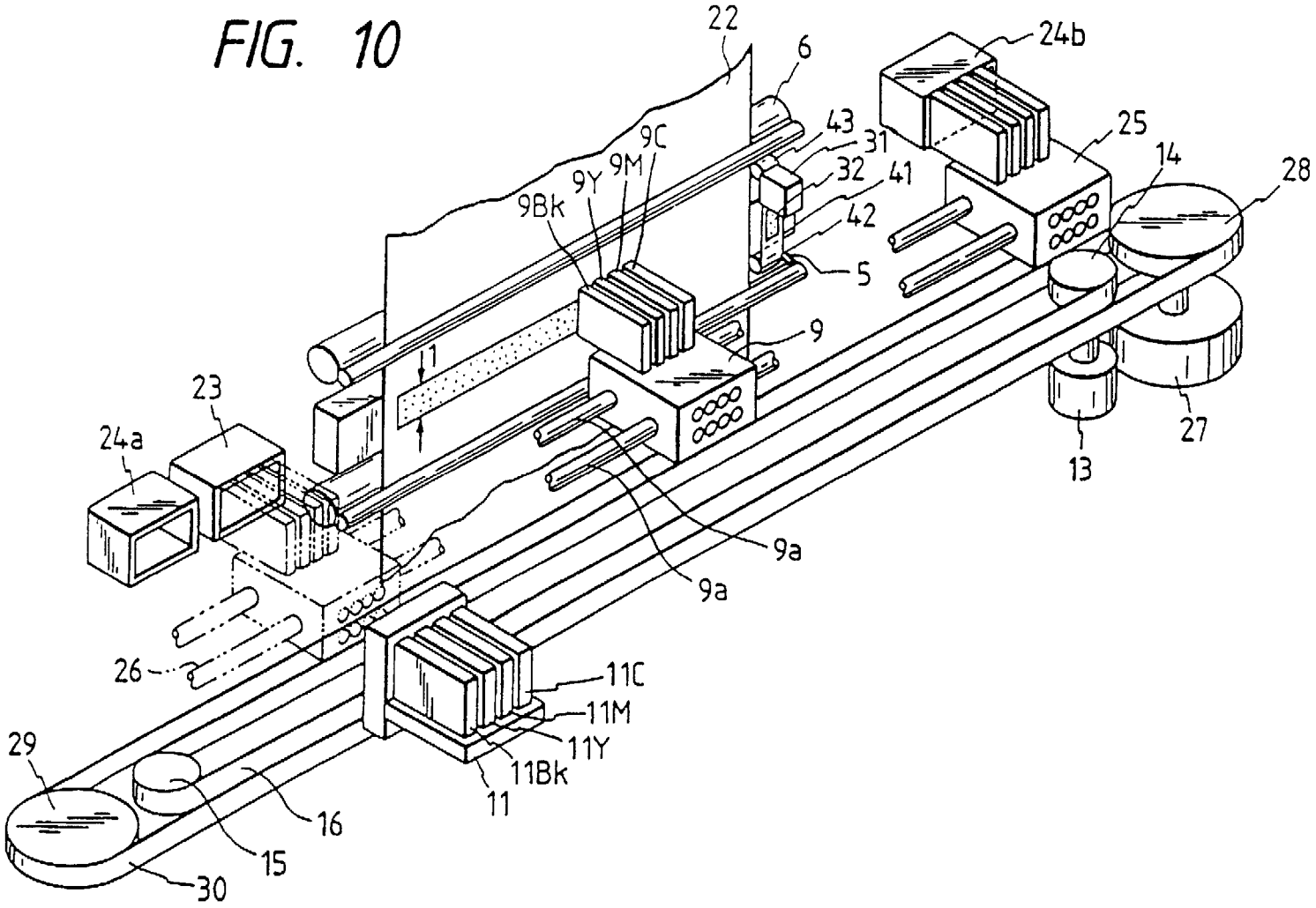
FIG. 10 is a perspective view of a recording head and related mechanisms in a modification of the third embodiment of the present invention.

In the present embodiment, the calibration pattern is printed in the margin of the recording material 22, but as an alternative it is also possible, as in the second embodiment, to provide a small-sized recording material 41 for said calibration pattern, as shown in FIG. 10, and to print the calibration pattern at a predetermined interval.

Also in the present embodiment, the recording material is assumed to be composed of ordinary paper, but similar effects can be obtained on other recording materials such as woven fabric.

Also in the foregoing embodiments, the interval of detection of unevenness and discharge failure, or the timing of printing of the calibration pattern, is not particularly defined, but such calibrating operation may be conducted every line or every certain number of lines. The abnormality can be detected on real time basis if the calibration is conducted every line. On the other hand, a loss in the recording speed can be prevented by conducting the calibration at every certain number of lines.

Said interval is preferably varied according to the kind of the recording material. More specifically, said interval is preferably made shorter for a recording material with a rougher surface, such as woven cloth, since short fibers tend to adhere around the nozzles of the recording head.

As explained in the foregoing, the present invention always monitors the unevenness and discharge failure of the recording heads, whereby the correction for unevenness and the discharge recovery operation can be realized in an unmanned state and the deterioration in image quality can be prevented.

Among various ink jet recording systems, the present invention brings about a particular effect when applied to a recording head and an ink jet recording system utilizing thermal energy for ink discharge.

The principle and representative configuration of said system are disclosed, for example, in the U.S. Pat. Nos. 4,723,129 and 4,740,796. This system is applicable to so-called on-demand recording or continuous recording, but is particularly effective in the on-demand recording because, in response to the application of at least a drive signal representing the recording information to an electrothermal converter element positioned corresponding to a liquid channel or a sheet containing liquid (ink) therein, said element generates thermal energy capable of causing a rapid temperature increase exceeding the nucleate boiling point, thereby inducing film boiling on a heat action surface of the recording head and thus forming a bubble in said liquid (ink), in one-to-one correspondence with said drive signal. Said liquid (ink) is discharged through a discharge opening by the growth and contraction of said bubble, thereby forming at least a liquid droplet. Said drive signal is preferably formed as a pulse, as it realizes instantaneous growth and contraction of the bubble, thereby attaining highly responsive discharge of the liquid (ink). Such a pulse-shaped drive signal is preferably that disclosed in the U.S. Pat. Nos. 4,463,359 and 4,345,262. Also the conditions described in the U.S. Pat. No. 4,313,124 relative to the temperature increase rate of said heat action surface allows to obtain further improved recording.

The configuration of the recording head is given by the combinations of the liquid discharge openings, liquid channels and electrothermal converter elements with linear or rectangular liquid channels, disclosed in the above-mentioned patents, but a configuration disclosed in the U.S. Pat. No. 4,558,333 in which the heat action part is positioned in a flexed area, and a configuration disclosed in the U.S. Pat. No. 4,459,600 are also useable in the present invention. Furthermore the present invention is effective in a structure disclosed in the Japanese Patent Laid-open Application No. 59-123670, having a slit common to plural electrothermal converter elements as discharge opening therefor, or in a structure disclosed in the Japanese Patent Laid-open Application No. 59-138461, having an aperture for absorbing the pressure wave of thermal energy, in correspondence with each discharge opening.

A full-line type recording head, capable of simultaneous recording over the entire width of the recording sheet, may be obtained by plural recording heads so combined as to provide the required length as disclosed in the above-mentioned patents, or may be constructed as a single integrated recording head, and the present invention can more effectively exhibit its advantages in such recording head.

The present invention is further more effective in a recording head of interchangeable chip type, which can receive ink supply from the main apparatus and can be electrically connected therewith upon mounting on said main apparatus, or a recording head of cartridge type in which an ink cartridge is integrally constructed with the recording head.

Also the recording apparatus is preferably provided with the emission recovery means and other auxiliary means for the recording head, since the effects of the recording head of the present invention can be stabilized further. Examples of such means for the recording head include capping means, cleaning means, pressurizing or suction means, preliminary heating means composed of an electrothermal converter element and/or another heating device, and means for effecting an idle ink discharge independent from the recording operation, all of which are effective for achieving stable recording operation.

Furthermore, the present invention is not limited to a recording mode for recording a single main color such as black, but is extremely effective also to the recording head for recording plural different colors or full color by color mixing, wherein the recording head is either integrally constructed or is composed of plural units.

What is claimed is:

1. A recording apparatus for recording an image by scanning a recording head relative to a recording medium of a particular type, with the recording head having a recording state and a non-recording state, a substantially entire area of the recording medium being a recording area to be recorded according to an image signal, the recording medium having no predetermined margin area, said apparatus comprising:

pattern recording means for controlling recording of a predetermined pattern with said recording head at a predetermined timing, said pattern recording means recording the predetermined pattern on a pattern recording medium different from the recording medium, said pattern recording means recording the predetermined pattern at a recording position different from that at which the recording medium is recorded, the recording medium having a recording surface rougher than a recording surface of the pattern recording medium;

reader means for reading the predetermined pattern recorded using said pattern recording means;

restoring means for performing a discharge restoring operation of said recording head;

means for enabling a second recording head different from said recording head to record an image to be recorded by said recording head;

discrimination means for discriminating a recording state of said recording head, based on the predetermined pattern read by said reader means; and control means for driving said enabling means to enable said second recording head to record the image to be recorded by said recording head, in a case that after said discriminating means discriminates the recording state as being poor and thereafter the discharge restoring operation performed by said restoring means and a pattern recording operation by said pattern recording means have been executed a predetermined number of times, said discriminating means has discriminated the recording state as being still poor.

2. A recording apparatus according to claim 1, wherein said reader means includes illumination means for illuminating the recorded predetermined pattern, projection means for projecting the predetermined pattern illuminated by said illumination means as an optical image, and a photoelectric converting device for converting the optical image of the predetermined pattern, projected by said projection means, into electrical signals.

3. A recording apparatus according to claim 2, wherein the effective number of elements in said photoelectric converting device is equal to or larger than the number of recording elements of said recording head.

4. A recording apparatus according to claim 1, wherein the recording medium is formed as a continuous web sufficiently long in one direction.

5. A recording apparatus according to claim 1, wherein said control means executes an unevenness correction process when said discrimination means determines that the recording state of said recording head results in recording with unevenness.

6. A recording apparatus according to claim 1, wherein said recording head is adapted to discharge ink from a discharge opening.

7. A recording apparatus according to claim 6, wherein said recording head includes thermal energy generating means, provided near said discharge opening, for causing a thermal state change in the ink, thereby discharging the ink from said discharge opening by said state change and forming a flying liquid droplet.

8. A recording apparatus according to claim 1, wherein said control means executes an ink discharge restoring process for said recording head, when said discrimination means determines that the recording state of said recording head indicates an ink discharge failure.

9. A recording apparatus according to claim 1, wherein said recording head is capable of recording with plural colors.

10. A recording apparatus according to claim 1, wherein the recording medium comprises woven cloth.

11. A recording method for recording an image by scanning a recording head relative to a recording medium of a particular type while discharging ink, with the recording head having a recording state and a non-recording state, a substantially entire area of the recording medium being a recording area to be recorded according to an image signal, the recording medium having no predetermined margin area, said method comprising the steps of:

recording a predetermined pattern with the recording head at a predetermined timing, said pattern recording step recording the predetermined pattern on a pattern recording medium different from the recording medium, said pattern recording step recording the predetermined pattern at a recording position different from that at which the recording medium is recorded, the recording medium having a recording surface rougher than a recording surface of the pattern recording medium;

reading the recorded predetermined pattern;

discriminating whether a recording state of the recording head indicates ink discharge failure, based on the read predetermined pattern;

effecting a process for restoring ink discharge of the recording head, when in said discriminating step it is discriminated that the recording state indicates ink discharge failure;

executing said recording step, said reading step, said discriminating step and said restoring process effecting step repeatedly a predetermined number of times; and enabling a second recording head different from the recording head to record an image to be recorded by the recording head, in a case that after said discriminating step discriminates the recording state indicating ink discharge failure and thereafter a discharge restoring operation by said restoring process effecting step and a pattern recording operation by said pattern recording step have been executed a predetermined number of times, said discriminating step has discriminated the recording state still indicates the ink discharge failure.

12. A recording method according to claim 11, wherein the recording medium is formed as a continuous web sufficiently long in one direction.

13. A recording method according to claim 11, wherein the recording head is capable of recording with plural colors.

14. A recording method according to claim 11, wherein the recording medium comprises a woven cloth.

15. A method according to claim 11, further comprising the steps of discriminating whether the recording state of the recording head has resulted in unevenness on the basis of the read predetermined pattern; executing an unevenness correction process when it is determined in said unevenness discriminating step that the recording state has resulted in unevenness, conducting repeatedly said recording step, said reading step, said unevenness discriminating step and said unevenness correction process executing step; and causing an alarm when the number of times of repeating in said repeat conducting step exceeds a second predetermined number of times.

16. A recording method for recording an image by scanning a recording head relative to a recording medium of a particular type while discharging ink, with the recording head having a recording state and a non-recording state, a substantially entire area of the recording medium being a recording area to be recorded according to an image signal, the recording medium having no predetermined margin area, said method comprising the steps of:

recording a predetermined pattern with the recording head at a predetermined timing, said pattern recording step recording the predetermined pattern on a pattern recording medium different from the recording medium, said pattern recording step recording the predetermined pattern at a recording position different from that of which the recording medium is recorded, the recording medium having a recording surface rougher than a recording surface of the pattern recording medium;

reading the recorded predetermined pattern;

discriminating whether a recording state of the recording head has resulted in unevenness on the basis of the read predetermined pattern;

executing an unevenness correction process when it is determined in said unevenness discriminating step that the recording state has resulted in unevenness;

conducting repeatedly said recording step, said reading step, said unevenness discriminating step and said unevenness correction process executing step a predetermined number of times; and enabling a second recording head different from the recording head to record an image to be recorded by said recording head, in a case that after said discriminating step discriminates the recording state resulting in unevenness and thereafter an unevenness correction process by said unevenness correction process executing step and a pattern recording operation by said pattern recording step have been executed a predetermined number of times, said discriminating step has discriminated the recording state still results in unevenness.

17. A recording method according to claim 16, wherein the recording medium is formed as a continuous web sufficiently long in one direction.

18. A recording method according to claim 16, wherein the recording head is capable of recording with plural colors.

19. A recording method according to claim 16, wherein the recording medium comprises a woven cloth.

20. A recording method for recording an image by scanning a recording head relative to a recording medium of a particular type while discharging ink, with the recording head having a recording state and a non-recording state, said method comprising the steps of:

recording a predetermined pattern with the recording head at a predetermined timing on a pattern recording medium different from the recording medium and at a recording position different from that of which the recording medium is recorded;

reading the recorded predetermined pattern;

discriminating whether a recording state of the recording head indicates ink discharge failure based on the read predetermined pattern;

effecting a process for restoring ink discharge of the recording head, when in said discriminating step it is discriminated that the recording state indicates ink discharge failure;

executing said recording step, said reading step, said discriminating step and said restoring process effecting step repeatedly a predetermined number of times; and enabling a second recording head different from the recording head to record an image to be recorded by the recording head, in a case that after said discriminating step discriminates the recording state indicating ink discharge failure and thereafter a discharge restoring process by said restoring process effecting step and a pattern recording operation by said pattern recording step have been executed a predetermined number of times, said discriminating step has discriminated the recording state still indicates the ink discharge failure.

21. A recording method according to claim 20, wherein a substantially entire area of the recording medium is a recording area to be recorded according to an image signal, the recording medium having no predetermined margin area.

22. A recording method according to claim 20, wherein the recording medium has a recording surface rougher than a recording surface of the pattern recording medium.

23. A recording apparatus for recording an image by scanning a recording head relative to a recording medium of a particular type, with the recording head having a recording state and a non-recording state, said apparatus comprising:

pattern recording means for controlling recording of a predetermined pattern with said recording head at a predetermined timing, said pattern recording means recording the predetermined pattern on a pattern recording medium different from the recording medium, said pattern recording means recording the predetermined pattern at a recording position different from that at which the recording medium is recorded;

reader means for reading the predetermined pattern recorded using said pattern recording means;

restoring means for performing a discharge restoring operation of said recording head;

means for enabling a second recording head different from said recording head to record an image to be recorded by said recording head;

discrimination means for discriminating a recording state of said recording head, based on the predetermined pattern read by said reader means; and control means for driving said enabling means to enable said second recording head to record the image to be recorded by said recording head, in a case that after said discriminating means discriminates the recording state as being poor and thereafter the discharge restoring operation performed by said restoring means and a pattern recorded operation by said pattern recording means have been executed, said discriminating means has discriminated the recording state as being still poor.

24. A recording method for recording an image by scanning a recording head relative to a recording medium of a particular type while discharging ink, with the recording head having a recording state and a non-recording state, said method comprising the steps of:

recording a predetermined pattern with the recording head at a predetermined timing, said pattern recording step recording the predetermined pattern on a pattern recording medium different from the recording medium, said pattern recording step recording the predetermined pattern at a recording position different from that at which the recording medium is recorded;

reading the recorded predetermined pattern;

discriminating whether a recording state of the recording head indicates ink discharge failure, based on the read predetermined pattern;

effecting a process for restoring ink discharge of the recording head when in said discriminating step it is discriminated that the recording state indicates ink discharge failure;

executing said recording step, said reading step, said discriminating step and said restoring process effecting step; and enabling a second recording head different from the recording head to record an image to be recorded by the recording head, in a case that after said discriminating step discriminates the recording state indicating ink discharge failure and thereafter a discharge restoring operation by said restoring process effecting step and a pattern recording operation by said pattern recording step have been executed, said discriminating step has discriminated the recording state still indicates the ink discharge failure.

25. A recording method for recording an image by scanning a recording head relative to a recording medium of a particular type while discharging ink, with the recording head having a recording state and a non-recording state, said method comprising the steps of:

recording a predetermined pattern with the recording head at a desired timing on a pattern recording medium different from the recording medium and at a recording position different from that of which the recording medium is recorded;

reading the recorded predetermined pattern;

detecting record unevenness on the basis of the predetermined pattern;

executing a process for correcting a driving signal supplied to the recording head on the basis of the record unevenness detected in said detecting step;

executing said recording step, said reading step, said detecting step and said driving signal correction process executing step; and enabling a second recording head different from the recording head to record an image to be recorded by the recording head, in a case that after said detecting step detects the record unevenness and thereafter the process by said driving signal correction process executing step and a pattern recording operation by said pattern recording step have been executed, it is discriminated that the record unevenness is still retained.

26. A recording method for recording an image by scanning a recording head relative to a recording medium of a particular type while discharging ink, with the recording head having a recording state and a non-recording state, said method comprising the steps of:

recording a predetermined pattern with the recording head at a desired timing on a pattern recording medium different from the recording medium and at a recording position different from that of which the recording medium is recorded;

reading the recorded predetermined pattern;

detecting record unevenness on the basis of the predetermined pattern;

executing a process for correcting a driving signal supplied to the recording head on the basis of the record unevenness detected in said detecting step;

executing said recording step, said reading step, said detecting step and said driving signal correction process executing step; and enabling a second recording head different from the recording head to record an image to be recorded by the recording head, in a case that after said detecting step detects the record unevenness and thereafter the process by said driving signal correction process executing step and a pattern recording operation by said pattern recording step have been executed, it is discriminated that the record unevenness is still retained, wherein a substantially entire area of the recording medium is a recording area to be recorded according to an image signal, the recording medium having no predetermined margin area, and the recording medium has a recording surface rougher than a recording surface of the pattern recording medium.

27. A recording method for recording an image by scanning a recording head relative to a recording medium of a particular type while discharging ink, with the recording head having a recording state and a non-recording state, said method comprising the steps of:

recording a predetermined pattern with the recording head at a desired timing on a pattern recording medium different from the recording medium;

reading the recorded predetermined pattern;

detecting record unevenness based on the predetermined pattern;

executing a process for correcting a driving signal supplied to the recording head based on the record unevenness detected in said detecting step;

executing said recording step by supplying a corrected driving signal to the recording head, said reading step and said detecting step repeatedly at least a predetermined number of times; and enabling a second recording head different from the recording head to record an image to be recorded by the recording head, in a case that after said detecting step detects the record unevenness and thereafter the process by said driving signal correction process executing step and a pattern recording operation by said pattern recording step have been executed, it is determined that the record unevenness is still retained.

* * * * *

UNITED STATES PATENT AND TRADEMARK OFFICE

CERTIFICATE OF CORRECTION

PATENT NO. : 5,798,773 Page 1 of 2

DATED : August 25, 1998

INVENTOR(S) : HIRAMATUSU ET AL.

It is certified that error appears in the above-identified patent and that said Letters Patent is hereby corrected as shown below:

TITLE PAGE:

[56] References Cited:

FOREIGN PATENT DOCUMENTS, "1130948" should read --1-130948--.

In the Drawings:

Sheet 8, Figure 9, in Steps S1 and S10, "CALIBURATION" should read --CALIBRATION--.

COLUMN 1:

Line 46, "operation" should read --operator--.

COLUMN 2:

Line 56, "EMBODIMENT" should read --EMBODIMENTS--.

COLUMN 11:

Line 36, "of" should read --at--.

COLUMN 12:

Line 11, "of" should read --at--.

UNITED STATES PATENT AND TRADEMARK OFFICE

CERTIFICATE OF CORRECTION

PATENT NO. : 5,798,773 Page 2 of 2

DATED : August 25, 1998

INVENTOR(S) : HIRAMATUSU ET AL.

It is certified that error appears in the above-identified patent and that said Letters Patent is hereby corrected as shown below:

COLUMN 13:

Line 49, "of" should read --at--.

COLUMN 14:

Line 11, "of" should read --at--.

Signed and Sealed this

Thirty-first Day of August, 1999

*Attest:*

Q. TODD DICKINSON

*Attesting Officer*

*Acting Commissioner of Patents and Trademarks*